US009951780B2

(12) United States Patent
McKinzie et al.

(10) Patent No.: US 9,951,780 B2
(45) Date of Patent: Apr. 24, 2018

(54) MOTOR, CONTROLLER AND ASSOCIATED METHOD

(71) Applicant: Regal Beloit America, Inc., Beloit, WI (US)

(72) Inventors: Marc Christopher McKinzie, West Wilton, OH (US); Mitchell T. Kiser, Tipp City, OH (US); Stephen Douglas O'Brien, Troy, OH (US)

(73) Assignee: Regal Beloit America, Inc., Beloit, WI (US)

( * ) Notice: Subject to any disclaimer, the term of this patent is extended or adjusted under 35 U.S.C. 154(b) by 9 days.

(21) Appl. No.: 14/685,842

(22) Filed: Apr. 14, 2015

(65) Prior Publication Data

US 2016/0305434 A1 Oct. 20, 2016

(51) Int. Cl.

| | |
|---|---|
| ***F04D 15/00*** | (2006.01) |
| ***H02K 7/14*** | (2006.01) |
| ***E04H 4/00*** | (2006.01) |

(52) U.S. Cl.

CPC ..... *F04D 15/0066* (2013.01); *E04H 4/00* (2013.01); *F04D 15/0088* (2013.01)

(58) Field of Classification Search

CPC ..... F04D 15/0066; F04D 15/0088

USPC ..... 318/3

See application file for complete search history.

(56) References Cited

U.S. PATENT DOCUMENTS

| | | | | |
|---|---|---|---|---|
| 7,988,425 | B1 | 8/2011 | Stingl et al. | |
| 8,043,070 | B2 * | 10/2011 | Stiles, Jr. | F04B 49/20 417/326 |
| 8,480,373 | B2 | 7/2013 | Stiles et al. | |
| 2005/0123408 | A1 | 6/2005 | Koehl | |
| 2005/0226731 | A1 | 10/2005 | Mehlhorn et al. | |
| 2007/0154319 | A1 | 7/2007 | Stiles et al. | |
| 2007/0154320 | A1 | 7/2007 | Stiles et al. | |
| 2007/0154322 | A1 | 7/2007 | Stiles et al. | |
| 2007/0154323 | A1 | 7/2007 | Stiles et al. | |
| 2009/0151801 | A1 | 6/2009 | Gorman et al. | |
| 2010/0247332 | A1 | 9/2010 | Stiles et al. | |
| 2010/0254825 | A1 | 10/2010 | Stiles et al. | |
| 2011/0076156 | A1 | 3/2011 | Stiles et al. | |
| 2011/0091329 | A1 | 4/2011 | Stiles et al. | |
| 2012/0107140 | A1 | 5/2012 | Stiles et al. | |
| 2012/0117724 | A1 * | 5/2012 | Caudill | A61H 33/005 4/541.1 |
| 2012/0308402 | A1 | 12/2012 | Le et al. | |
| 2013/0106321 | A1 | 5/2013 | Drye et al. | |
| 2013/0251542 | A1 | 9/2013 | Stiles et al. | |
| 2014/0027359 | A1 | 1/2014 | Stiles et al. | |
| 2014/0064985 | A1 | 3/2014 | Stiles et al. | |
| 2014/0314582 | A1 | 10/2014 | Stiles et al. | |
| 2014/0334943 | A1 | 11/2014 | Koehl et al. | |
| 2014/0334944 | A1 | 11/2014 | Koehl et al. | |

(Continued)

*Primary Examiner* — Erick Glass

(74) *Attorney, Agent, or Firm* — John Wagley

(57) ABSTRACT

According to an embodiment of the invention, a pump motor controller for determining the speeds and run times of a pump motor for use in a pool is provided. The controller is adapted to receive data in the form of at least one of pool parameters, pump parameter and user preferences. The controller is further adapted to determine the speeds and run times of a pump motor for use in a pool based at least in part on data in the form of one of pool parameters, pump parameter and user preferences.

20 Claims, 6 Drawing Sheets

(56) References Cited

U.S. PATENT DOCUMENTS

| | | | |
|---|---|---|---|
| 2014/0363308 | A1 | 12/2014 | Stiles et al. |
| 2015/0030463 | A1 | 1/2015 | Stiles et al. |

* cited by examiner

| | | Example #1 | Example #2 | Example #3 | Importance | Default |
|---|---|---|---|---|---|---|
| Inputs | Pool size | 15000 | 20000 | 30000 | 6 | |
| | Plumbing size | 1.5 | 2 | 2 | 1 | |
| | # Skimmers | 2 | 2 | 2 | 2 | |
| | Impeller | 1.5 | 2 | 2.7 | | |
| | Pump manufacturer | Hayward | ZPS | ZPS | | |
| | Flow rate | 100 | 130 | 160 | 5 | |
| | Rated power | 1.5 | 2 | 2.7 | | |
| | Desired turnovers | 1.5 | 1.5 | 1 | 4 | |
| | Optimization method | | | | 3 | |
| | cleanest | X | | | | |
| | lowest cost | | X | | | |
| | quietest | | | X | | |
| | | | | | | |
| Outputs | Speed 1 [RPM] | 3410 | 850 | 600 | | 3100 |
| | Duration 1 [Hours] | 3.79 | 15.61 | 17.97 | | 2 |
| | Speed 2 [RPM] | 2600 | 2600 | 2600 | | 2600 |
| | Duration 2 [Hours] | 1.5 | 0.5 | 0.5 | | 4 |
| | Speed 3 [RPM] | 1725 | | | | 1725 |
| | Duration 3 [Hours] | 8 | | | | 8 |

FIG. 5

MOTOR, CONTROLLER AND ASSOCIATED METHOD

CROSS-REFERENCE TO RELATED APPLICATIONS

Cross reference is made to the following application: 14-FW-007-UPA1 titled "CONTROLLER, MOTOR ASSEMBLY AND ASSOCIATED METHOD" filed concurrently herewith which is incorporated herein by reference.

BACKGROUND OF THE INVENTION

The embodiments described herein relate generally to fluid moving devices and controller, and more specifically, to a pump motor controller.

Pool and spa pumps are used to circulate water within the pool. The circulation of the water disperses chemicals added to the water to provide for acceptable water conditions. The circulation also permits the passage of water through a filter to remove impurities from the water. Typically the pump operates for a portion of the week, typically on a schedule. The pump is typically powered by an electrical motor. The motor may be manually operated, wherein the operator manually controls the pump weekly cycle by manually turning the pump motor off and on.

More sophisticated pool pump systems have timers for turning the pump off and on based on a schedule. Some even more sophisticated pool pump systems have electronic controllers located in or adjacent the pool pump motors or within a pool system. These electronic controllers regulate the operation of the pool pump. These electronic controllers determine the on and off times of the pool pump motor. They may also control the speed of the pump if the pool pump motor has more than one possible speed.

These pool pump systems may not provide for optimum pool conditions either at set up or over time when pool conditions change. These systems require periodic adjustments to the scheduled on off times and to the motor speeds to obtain optimum efficiency. Such systems may not provide for optimum pool conditions at initial set up and may not provide for optimum pool conditions when adjustments are made to respond to changing pool conditions. Typically such pool pump motor scheduling is made with a trial and error approach.

The present invention is directed to alleviate at least some of these problems with the prior art.

BRIEF DESCRIPTION OF THE INVENTION

According to an embodiment of the invention, a pump motor controller for determining the speeds and run times of a pump motor for use in a pool is provided. The controller is adapted to receive data in the form of at least one of pool parameters, pump parameter and user preferences. The controller is further adapted to determine the speeds and run times of a pump motor for use in a pool based at least in part on data in the form of one of pool parameters, pump parameters and user preferences.

According to an aspect of the present invention, the pump motor controller may be adapted to communicate with other pool devices to turn them off and on based at least in part on one of data in the form of one of pool parameters, pump parameter and user preferences.

According to another aspect of the present invention, the pump motor controller may be adapted to adjust motor speed to achieve maximum efficiency while reaching and maintaining desired pool parameters, pump parameter and user preferences.

According to yet another aspect of the present invention, the pump motor controller may be adapted to determine the speeds and run times of a pump motor for use in a pool based at least in part on data in the form of at least two of pool parameters, pump parameter and user preferences.

According to a further aspect of the present invention, the pump motor controller may be adapted to determine the speeds and run times of a pump motor for use in a pool based at least in part on data in the form of pool parameters, pump parameter and user preferences.

According to a further aspect of the present invention, the data in the form of pool parameters may include at least one of pool size, plumbing size and number of skimmers.

According to a further aspect of the present invention, the data in the form of pump parameters may include at least one of impeller specifics, pump manufacturer, pump flow rate and pump horsepower.

According to a further aspect of the present invention, the data in the form of user preferences may include at least one of desired turnovers and desired operation method.

According to a further aspect of the present invention, the data in the form of user preferences may include a desired operation method and the desired operation method may be one of cleanest, lowest cost, quietest and highest flow.

According to another embodiment of the invention, an electric motor assembly for use to power a pump in a pool is provided. The electric motor assembly includes a motor adapted to be connected to the pump and a pump motor controller. The pump motor control is adapted for controlling the motor. The controller is adapted to receive data in the form of at least one of pool parameters, pump parameter and user preferences. The controller is adapted to determine the speeds and run times of a pump motor for use in a pool based at least in part on data in the form of one of pool parameters, pump parameter and user preferences.

According to an aspect of the present invention, the controller of the electric motor assembly may be adapted to adjust motor speed to achieve maximum efficiency while reaching and maintaining desired pool parameters, pump parameter and user preferences.

According to another aspect of the present invention, the controller of the electric motor assembly may be adapted to determine the speeds and run times of a pump motor for use in a pool based at least in part on data in the form of at least two of pool parameters, pump parameter and user preferences.

According to yet another aspect of the present invention, the controller of the electric motor assembly may be adapted to determine the speeds and run times of a pump motor for use in a pool based at least in part on data in the form of pool parameters, pump parameter and user preferences.

According to another aspect of the present invention, the controller of the electric motor assembly may be adapted to determine the speeds and run times of a pump motor for use in a pool based at least in part on data in the form of at least one of pool parameters, pump parameter, user preferences, and run times.

According to another aspect of the present invention, the controller of the electric motor assembly may be adapted to determine the speeds and run times of a pump motor for use in a pool based at least in part on data in the form of at least one of pool parameters, pump parameter, user preferences, and speeds.

According to a further aspect of the present invention, the data in the form of user preferences may include at least one of pool size, plumbing size and number of skimmers According to a further aspect of the present invention, the data in the form of user preferences may include at least one of impeller specifics, pump manufacturer, pump flow rate and pump horsepower.

According to a further aspect of the present invention, the data in the form of user preferences may include at least one of desired turnovers and desired operation method.

According to a further aspect of the present invention, the data in the form of user preferences may include a desired operation method and the desired operation method may be one of cleanest, lowest cost, quietest and highest flow.

According to another embodiment of the invention, a method for determining the speeds and run times of a pump motor for use in a pool is provided. The method includes the steps of providing a pump motor, receiving data in the form of at least one of pool parameters, pump parameter and user preferences and determining the speeds and run times of a pump motor for use in a pool based at least in part on data in the form of one of pool parameters, pump parameter and user preferences.

According to another aspect of the present invention, the step of determining the speeds and run times of a pump motor may include determining the speeds and run times of a pump motor for use in a pool based at least in part on data in the form of at least two of pool parameters, pump parameter and user preferences.

According to yet another aspect of the present invention, the step of determining the speeds and run times of a pump motor may include determining the speeds and run times of a pump motor for use in a pool based at least in part on data in the form of pool parameters, pump parameter and user preferences.

BRIEF DESCRIPTION OF THE DRAWINGS

FIG. 5 is a table used in the control logic of the controller of the of the pool pump assembly of FIG. 3, showing the pool and pool system inputs and outputs.

DETAILED DESCRIPTION OF THE INVENTION

Figure 1:
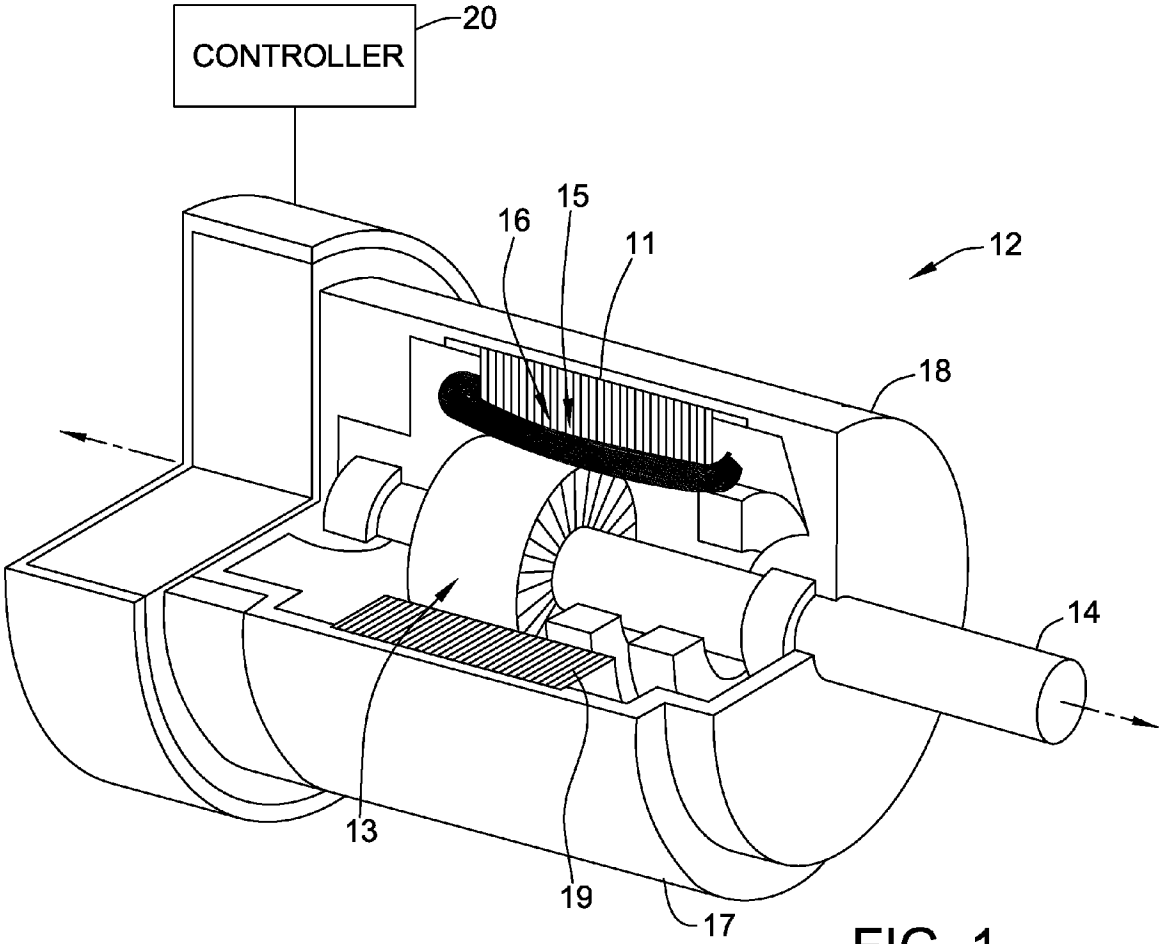
FIG. 1 is a perspective view, partially in cross section, of an embodiment of the present invention in the form of an electric motor assembly.

Pool and spa pumps are used to circulate water within the pool. The circulation of the water disperses chemicals added to the water to provide for acceptable water conditions. The circulation also permits the passage of water through a filter to remove impurities from the water, to aerate the water, and to provide uniform water temperature in the pool. Typically the pump operates for a portion of the week, typically on a schedule. The pump is typically powered by an electrical motor. The motor may be manually operated, wherein the operator manually controls the pump weekly cycle by manually turning the pump motor off and on.

The electrical motor typically includes a housing for containing and supporting a stator which is excited by an electrical source that excites an electromagnetic field in coils in the stator. The coils interact with a rotor rotatably supported in the housing to provide the mechanical rotational energy for the electrical machine.

Many modern electric machines include a control, for controlling the motor. The control may control the speed and direction of the motor by, for example, controlling the electrical energy going to the coils. The control typically includes a plurality of electrical components.

The electric machine typically includes a housing for containing and supporting the stator. While the electrical components may be positioned in a separate control, spaced from the housing of the electric machine, typically, to reduce cost, to reduce space requirements or for other reasons, at least a portion of the electrical components are positioned within the electric machine housing.

More sophisticated pool pump systems have timers for turning the pump off and on based on a schedule. Some even more sophisticated pool pump systems have electronic controllers located in or adjacent the pool pump motors or within a pool system. These electronic controllers regulate the operation of the pool pump. These electronic controllers determine the on and off times of the pool pump motor. They may also control the speed of the pump if the pool pump motor has more than one possible speed.

These pool pump systems may not provide for optimum pool conditions either at set up or over time when pool conditions change. These systems require periodic adjustments to the scheduled on and off times and to the motor speeds to obtain optimum efficiency. Such systems may not provide for optimum pool conditions at initial set up and may not provide for optimum pool conditions when adjustments are made to respond to changing pool conditions. Typically such pool pump motor scheduling is made with a trial and error approach.

Improved pool pump motor scheduling is desirable in the design and manufacture of electrical motors and controllers. The method, systems and apparatus described herein facilitate improved pool pump motor scheduling. Designs and methods are provided herein to facilitate improved pool pump motor scheduling.

Technical effects of the methods, systems, and apparatus described herein include at least one of reduced cost, improved serviceability, improved performance and quality and reduced labor costs.

According to an embodiment of the present invention and referring to FIG. 1, an electric machine 12 is provided. The electric machine 12 may be an electric motor or an electric generator, but hereinafter will be described as an electric motor 12. It should be appreciated that the electric motor may be used to power any mechanism, for example, a pump, a cyclic drive, a compressor, a vehicle, a fan or a blower.

The electric motor 12 typically includes a centrally located motor shaft 14 that rotates relative to the motor 12. Electrical energy is applied to coils 15 within the motor 12. The coils 15 generate an electromagnetic field that cooperates with an electromagnetic field in rotor 13 mounted to the motor shaft 14. The coils 15 initiate relative motion between the shaft 14 and the motor 12 that transfers the power from the coils 15 to the shaft 14.

A stationary assembly 16, also referred to as a stator, includes stator core 11 and coils 15 or windings positioned around portions of the stator core. It is these coils to which energy is applied to initiate this relative motion which transfers the power to the shaft. These coils 15 are formed by winding wire (not shown), typically copper, aluminum or a combination thereof, about a central core to form the winding or coil. An electric current is directed through the coils 15 which induces a magnetic field. It is the magnetic field that initiates this relative motion which transfers the power to the shaft 14. The stator core 11 typically includes a plurality of stator core laminations 19 that define stator teeth (not shown) around which the coils 15 are wound.

Typically the motor 12 includes a housing 17 having an inner wall or surface that defines a motor cavity therein. The housing 17 may include a plurality of components and may be made of a suitable durable material, for example a metal, a polymer or a composite. The housing 17 may, as shown, include a cylindrical shell 18 and opposed end caps (not shown).

It should be appreciated that the housing of the motor may have any suitable shape. One common shape of a motor housing is that of a cylindrical solid, having a generally cylindrical cross section. The shaft on a motor with such a shape generally extends from an end of the motor.

The motor 12 may have any suitable size and shape and may be, for example, an induction motor, a permanent-split capacitor (PSC) motor, an electronically commutated motor (ECM) motor, or a switched reluctance motor. The motor 12 may, as shown, be a radial flux motor or may be an axial flux motor. The housing 17 may include protrusions, for example fins (not shown), for dissipation of heat. The motor 12 may also include a fan (not shown) positioned within housing 17. The motor 12 may be electronically controlled, particularly if the motor is an ECM motor, by, for example a motor controller 20. The motor controller 20 may be internally or externally mounted to the motor 12. Alternatively, the controller 20 may be spaced from the motor 12 and may, for example be a part of a system controller (not shown).

Figure 2:
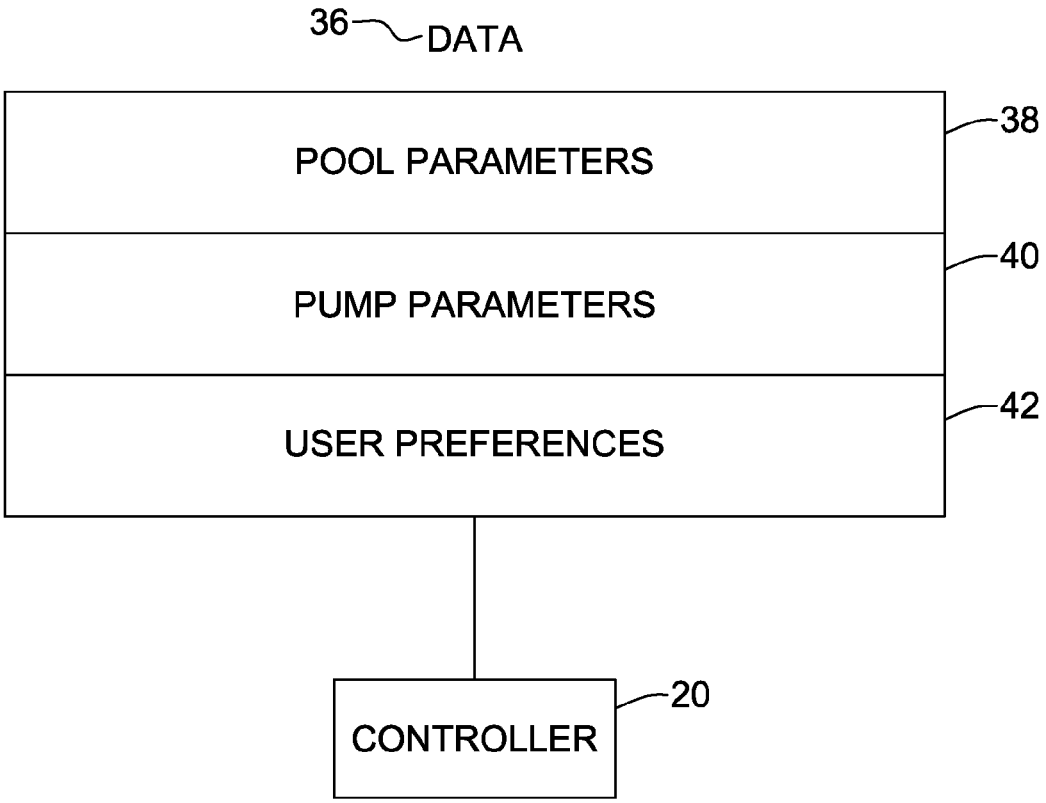
FIG. 2 is a schematic view of another embodiment of the present invention in the form of a motor controller for a motor.
Figure 3:
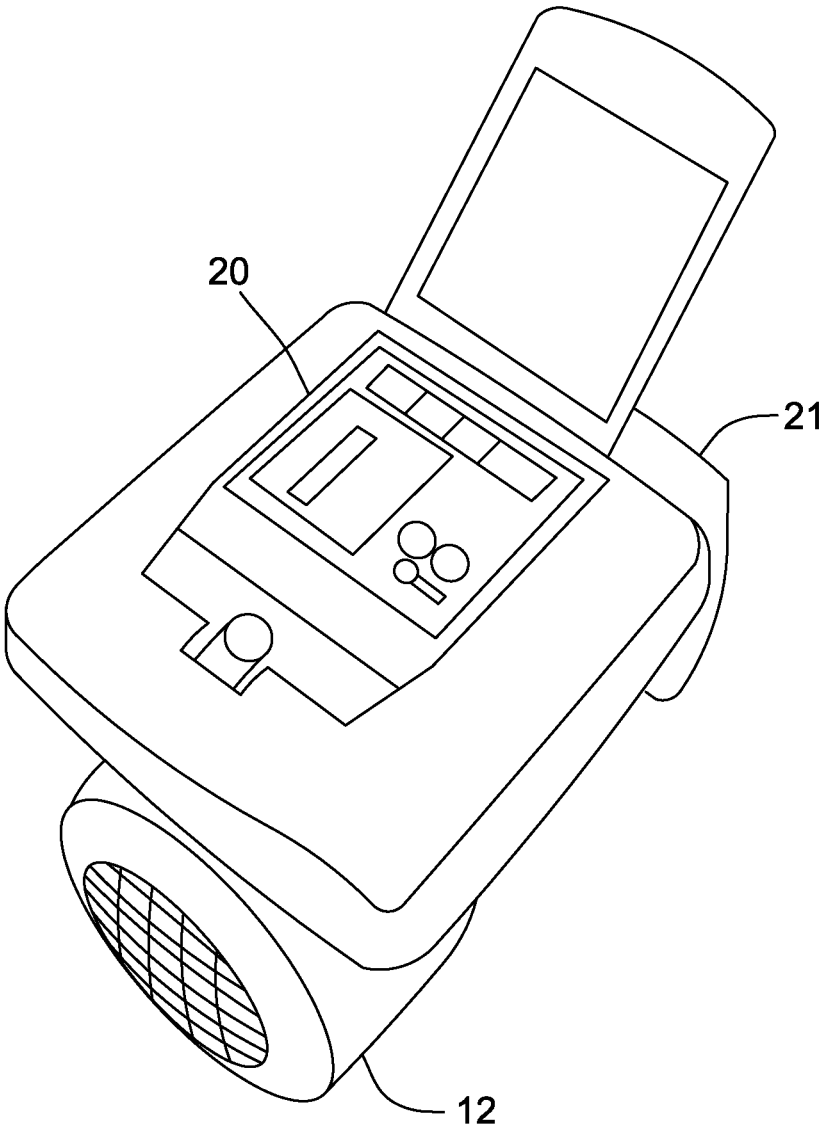
FIG. 3 is a perspective view, partially in cross section, of an embodiment of the present invention in the form of an pool pump assembly.
Figure 4:
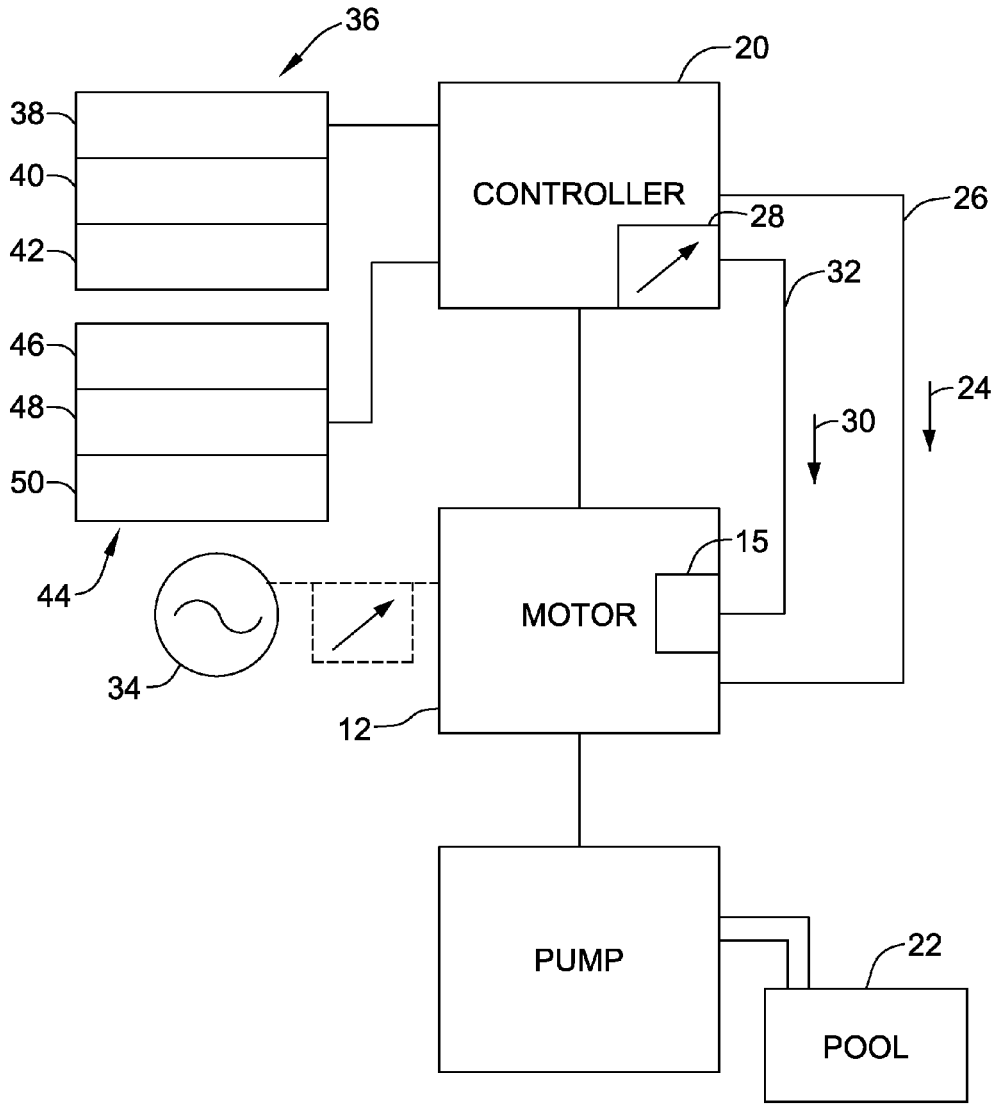
FIG. 4 is a schematic view of the pool pump assembly of FIG. 3.

According to an embodiment of the invention and referring now to FIGS. 2-4, the pump motor controller 20 is provided. The pump motor controller 20 is utilized to determine speeds and run times of the pump motor 12 for powering a pool pump 21 for use in a pool 22.

For example and as shown in FIG. 4, a speed signal 24 or multiple signals may be sent from the controller 20 to the motor 12 to energize the coils 15 in such a manner to obtain the desired speed. The speed signal 24 may be sent by, for example, a speed signal electrical conduit 26.

The pump motor controller 20 may be any suitable controller capable of controlling the motor and capable of receiving signals to so control the motor 12. The controller 20 may include a circuit board or boards (not shown) that are adapted to receive electronic components (not shown), in the form of, for example, discrete components, integrated circuits or some combination thereof.

The pump motor controller 20 may, for example, include a timer 28 which may be used to determine the run time(s) of the pump motor 12. The timer 28 may be integral with the controller 20 or may be a separate component. The timer 28 and/or the controller 20 may send a run time signal 30 or multiple signals through, for example, a run time electrical conduit 32. Alternatively the timer 28 may be positioned between power source 34 and the controller 20 and the timer 28 may be used to permit power to the controller when the time(s) selected for the pump to operate occur(s).

As shown in FIG. 2, the controller 20 is adapted to receive data 36. The data 36 may be analog or digital. The data 36 may be any data useful in determining pool pump motor speeds and run times for optimum pool water management. For example, the data 36 may be in the form pool parameters 38, pump parameter 40 or user preferences 42, or a combination thereof.

The pool parameters 38 may, for example, include pool size, plumbing size, plumbing length, number of skimmers, and number of drains. Pool size may, for example, include the dimensions of the pool, the pool shape, the number of cubic feet of water or the number of gallons of water. The plumbing size may, for example, include the diameter of the pipes. The plumbing length may, for example, include the number of pipe sections and the length of those sections.

The pump parameters 40 may, for example, include impeller specifics, pump manufacturer, pump flow rate, pump speeds and pump horsepower.

The user preferences 42 may, for example, include desired turnovers and desired operation method. The desired operation method may be a method based on being one of the cleanest method, the lowest cost method, the quietest method and the highest flow method.

Referring again to FIG. 4, the pump motor controller 20 may be adapted to communicate with other pool devices 44. For example, the other pool devices 44 may include a water heater 46, a chlorinator 48 or a skimmer 50

The pump motor controller 20 may be configured to turn the other pool devices 44 off and on based at least in part on one of data 36 in the form of one of pool parameters 38, pump parameters 40 and user preferences 42.

The pump motor controller 20 may be adapted to adjust motor speed of the motor 12 to achieve a maximum efficiency while reaching and maintaining desired pool parameters, pump parameters and user preferences.

While only one of pool parameters 38, pump parameters 40 and user preferences 42 may be needed to determine the speeds and run times of pump motor 12, more than one of pool parameters 38, pump parameters 40 and user preferences 42 may be used. For example, pool parameters 38 and user preferences 42, pool parameters 38 and pump parameters 40, or pump parameters 40 and user preferences 42 may be used. Alternatively, all three of pool parameters 38, pump parameters 40 and user preferences 42 may be used. Alternatively and/or in addition, the speeds may be dependent on the durations and the durations may be dependent on the speeds.

The determination of the speeds and run times of the pump motor 12 may be performed by the pump motor controller 20 or a similar controller such as a pool system controller. The determination of the speeds and run times may be determined by providing or utilizing code for the controller. The determination of the speeds and run times may be based on formulas and or by the use of tables which provide pump speeds and run times based on inputs to the controller of pool parameters, pump parameters and/or user preferences. Expressed in mathematical terms:

$$\text{Speed } 1 = fn(\text{pop}_n, \text{pup}_m, \text{up}_p, \text{dur}_1) n=1, \ldots, N; \; m=1, \ldots, M; \; p=1, \ldots, P$$

$$\text{Speed } 2 = fn(\text{pop}_n, \text{pup}_m, \text{up}_p, \text{dur}_2) n=1, \ldots, N; \; m=1, \ldots, M; \; p=1, \ldots, P$$

$$\text{Speed } 3 = fn(\text{pop}_n, \text{pup}_m, \text{up}_p, \text{dur}_3) n=1, \ldots, N; \; m=1, \ldots, M; \; p=1, \ldots, P$$

$$\text{Duration } 1 = fn(\text{pop}_n, \text{pup}_m, \text{up}_p, \text{spe}_1) n=1, \ldots, N; \; m=1, \ldots, M; \; p=1, \ldots, P$$

$$\text{Duration } 2 = fn(\text{pop}_n, \text{pup}_m, \text{up}_p, \text{spe}_2) n=1, \ldots, N; m=1, \ldots, M; p=1, \ldots, P$$

$$\text{Duration } 3 = fn(\text{pop}_n, \text{pup}_m, \text{up}_p, \text{spe}_3) n=1, \ldots, N; m=1, \ldots, M; p=1, \ldots, P$$

Where: pop=pool parameters
pup=pump parameters
up=user preferences
dur=duration
spe=speed
fn=function
n=number of that variable These above equations can be determined based on empirical data obtained by varying one or more variables and plotting the results.

Note that the equation above assumes that the function is only dependent on the corresponding speed or duration. Alternatively, the equation may be dependent on additional speeds and durations.

Referring now to FIG. 5, a table of inputs (pool parameters [pool size=$pop_1$, plumbing size=$pop_2$, #(number of) skimmers=$pop_3$,] pump parameters [impeller=$pup_1$, manufacturer=$pup_2$, flow rate=$pup_3$, rated power=$pup_4$,] and user preferences [desired turnovers=$pup_1$, optimization method=$pup_2$]) and outputs (speeds and run times) is shown. Note that each output, (Speed 1, Duration 1, Speed 2, Duration 2, Speed 3, and Duration 3), may only vary on some of the input and be unaffected by some other inputs. Note that one or more of the outputs may be zero.

For example and again referring to FIG. 5, Duration 1 may be a function of Pool size, Flow rate, Speed 1 and Desired turnovers.

Figure 6:
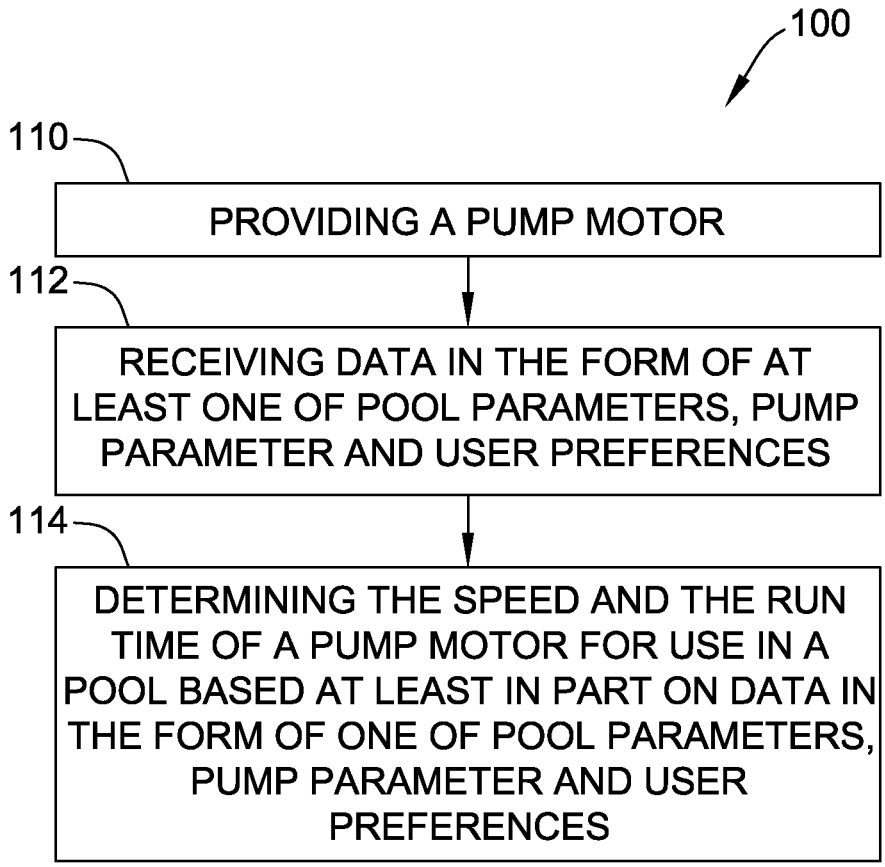
FIG. 6 is a flow chart of another embodiment of the present invention in the form of a method for providing controlling a motor.

Referring to FIG. 6, a method 100 for determining the speeds and run times of a pump motor for use in a pool is provided. The method 100 includes step 110 of providing a pump motor, step 112 of receiving data in the form of at least one of pool parameters, pump parameter and user preferences and step 114 of determining the speeds and run times of a pump motor for use in a pool based at least in part on data in the form of one of pool parameters, pump parameter and user preferences.

The method 100 may be provided such that step 114 of determining the speeds and run times of a pump motor may include determining the speeds and run times of a pump motor for use in a pool based at least in part on data in the form of at least two of pool parameters, pump parameter and user preferences.

The method 100 may be provided such that step 114 of determining the speeds and run times of a pump motor may include determining the speeds and run times of a pump motor for use in a pool based at least in part on data in the form of pool parameters, pump parameter and user preferences.

The methods, systems, and apparatus described herein facilitate efficient and economical assembly of an electric machine. Exemplary embodiments of methods, systems, and apparatus are described and/or illustrated herein in detail. The methods, systems, and apparatus are not limited to the specific embodiments described herein, but rather, components of each apparatus and system, as well as steps of each method, may be utilized independently and separately from other components and steps described herein. Each component, and each method step, can also be used in combination with other components and/or method steps.

When introducing elements/components/etc. of the methods and apparatus described and/or illustrated herein, the articles "a", "an", "the", and "the" are intended to mean that there are one or more of the element(s)/component(s)/etc. The terms "comprising", "including", and "having" are intended to be inclusive and mean that there may be additional element(s)/component(s)/etc. other than the listed element(s)/component(s)/etc.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

Described herein are exemplary methods, systems and apparatus utilizing an improved method and motor controller that reduces or eliminates the efficiency loss caused by a less optimum operation of the pump motor. Furthermore, the exemplary methods system and apparatus achieve increased efficiency while reducing effort in optimizing the operation of the pump motor. The methods, system and apparatus described herein may be used in any suitable application. However, they are particularly suited for pump applications.

Exemplary embodiments of the pool pump motor and controller are described above in detail. The electric machine and its components are not limited to the specific embodiments described herein, but rather, components of the systems may be utilized independently and separately from other components described herein. For example, the components may also be used in combination with other machine systems, methods, and apparatuses, and are not limited to practice with only the systems and apparatus as described herein. Rather, the exemplary embodiments can be implemented and utilized in connection with many other applications.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The methods, systems, and apparatus described herein facilitate pool pump motor scheduling of an electric machine. Exemplary embodiments of methods, systems, and apparatus are described and/or illustrated herein in detail. The methods, systems, and apparatus are not limited to the specific embodiments described herein, but rather, components of each apparatus and system, as well as steps of each method, may be utilized independently and separately from other components and steps described herein. Each component, and each method step, can also be used in combination with other components and/or method steps.

When introducing elements/components/etc. of the methods and apparatus described and/or illustrated herein, the articles "a", "an", "the", and "the" are intended to mean that there are one or more of the element(s)/component(s)/etc. The terms "comprising", "including", and "having" are intended to be inclusive and mean that there may be additional element(s)/component(s)/etc. other than the listed element(s)/component(s)/etc.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

Described herein are exemplary methods, systems and apparatus utilizing improved pool pump motor scheduling. Furthermore, the exemplary methods system and apparatus achieve improved pool pump motor scheduling. The methods, system and apparatus described herein may be used in any suitable application. However, they are particularly suited for pump applications.

Exemplary embodiments of the fluid flow device and system are described above in detail. The electric machine and its components are not limited to the specific embodiments described herein, but rather, components of the systems may be utilized independently and separately from other components described herein. For example, the components may also be used in combination with other machine systems, methods, and apparatuses, and are not limited to practice with only the systems and apparatus as described herein. Rather, the exemplary embodiments can be implemented and utilized in connection with many other applications.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A pool system for use in a pool, comprising:

an other pool device;

a pump for pumping water in the pool system; and a pump motor controller including:

a user interface for receiving data from a user, said user interface receiving data in the form of user preferences;

a processor for processing the data, said processor determines the speeds and run times of said pump based at least in part on data in the form of user preferences; and a communication port for transmitting signals to the pump motor in the form of at least one of pool parameters, pump parameter and user preferences, for determining the speeds and run times of said pump, and for communicating with said other pool device and for turning said other pool device off and on based at least in part on the data in the form of user preferences, wherein data in the form of user preferences comprises a desired operation method in which the selections of pump motor speeds and duration of operation are converted into easier to understand user choice priorities of cleanliness, costs, quietness and flow and wherein the data includes a choice of pump manufacturers, from a plurality of pump manufacturers.

2. The pool system for use in a pool according to claim 1, wherein said controller is adapted to determine the speeds and run times of the pump motor for use in the pool based at least in part on data in the form of at least two of pool parameters, pump parameter and user preferences.

3. The pool system for use in a pool according to claim 1, wherein said controller is adapted to determine the speeds and run times of the pump motor for use in the pool based at least in part on data in the form of pool parameters, pump parameter and user preferences.

4. The pool system for use in a pool according to claim 1:

wherein the data comprises data in the form of pool parameters; and wherein data in the form of pool parameters comprises at least one of pool size, plumbing size and number of skimmers.

5. The pool system for use in a pool according to claim 1:

wherein the data comprises data in the form of pump parameters; and wherein data in the form of pump parameters comprises at least one of impeller specifics, pump manufacturer, pump flow rate and pump horsepower.

6. The pool system for use in a pool according to claim 1:

wherein the data comprises data in the form of user preferences; and wherein data in the form of user preferences comprises at least one of desired turnovers and desired operation method.

7. The pool system for use in a pool according to claim 6, wherein the data in the form of user preferences comprises desired turnovers.

8. The pool system for use in a pool according to claim 4, wherein data in the form of pool parameters comprises pool size, plumbing size and number of skimmers.

9. The pool system for use in a pool according to claim 5, wherein data in the form of pump parameters comprises impeller specifics, pump manufacturer, pump flow rate and pump horsepower.

10. The pool system for use in a pool according to claim 6, wherein data in the form of user preferences comprises desired operation method.

11. The pool system for use in a pool according to claim 1, wherein said controller includes a table of inputs corresponding to the pool parameters, pump parameter and user preferences and including one of a table of outputs and formulas to determine of the speeds and run times may be based on the pool parameters, pump parameter and user preferences.

12. The pool system for use in a pool according to claim 11, wherein the one of a table of outputs and formulas comprises a table of outputs.

13. A pool system for use in a pool, comprising:

a pump for pumping water in the pool system; and a pump motor adapted to be connected to said pump; and a pump motor controller for controlling said motor, wherein said controller receives data in the form of pump parameters, wherein said controller determines the speeds and run times of a said pump motor based at least in part on the data, said controller including a table of inputs corresponding to the pump parameters and including one of a table of outputs and formulas to determine of the speeds and run times based on the pump parameters, and wherein said controller communicates with at least one of a water heater, a chlorinator and a skimmer to turn them off and on based at least in part on one of data in the form of pump parameters, wherein data in the form of pump parameters comprises impeller specifics and wherein the table of inputs includes a choice of pump manufacturers, from a plurality of pump manufacturers.

14. The pool system for use in a pool according to claim 13, wherein the data in the form of user preferences comprises at least one of desired turnovers and desired operation method.

15. The pool system for use in a pool according to claim 13, wherein data in the form of user preferences comprises desired turnovers.

16. A pool system for use in a pool according to claim 13, wherein said controller communicates with a water heater, a chlorinator and a skimmer to turn them off and on based at least in part on one of data in the form of one of pool parameters, pump parameter and user preferences.

17. A method for controlling a pool system, comprising:

providing a pump motor;

receiving data in the form of pool parameters, pump parameter including a choice of pump manufacturers, from a plurality of pump manufacturers and user preferences;

providing a controller;

tabulating the data in the controller;

providing at least one of a water heater, a chlorinator and a skimmer;

communicating between the controller and the at least one of a water heater, a chlorinator and a skimmer;

turning said at least one of a water heater, a chlorinator and a skimmer off and on based on the data tabulated in the controller; and operating the pump motor bases at least partially upon the choice of pump manufacturers.

18. The method according to claim 17, further comprising the step of calculating the speeds and run times of the pump motor based at least in part on the data tabulated in the controller.

19. The method according to claim 18, wherein the step of calculating the speeds and run times of said pump motor includes the use of formulas.

20. The method according to claim 18, wherein the step of calculating the speeds and run times of said pump motor includes the use of tables.

* * * * *